US005247132A

United States Patent [19]

Henderson

[11] Patent Number: 5,247,132

[45] Date of Patent: Sep. 21, 1993

[54] ELECTRIC VIOLIN WITH MULTIPLE REGISTRATION POINTS

[76] Inventor: Robert D. Henderson, 912 Hamilton, Lebanon, Ind. 46052

[21] Appl. No.: 870,412

[22] Filed: Apr. 17, 1992

[51] Int. Cl.[5] ..... G10D 1/02; G10D 3/00; G10H 3/18

[52] U.S. Cl. ..... 84/735; 84/731; 84/274; 84/293; 84/DIG. 24

[58] Field of Search ..... 84/173, 267–294, 84/723, 724, 726–728, 731, 733, 734, DIG. 24

[56] References Cited

U.S. PATENT DOCUMENTS

D. 270,255 8/1983 Saidat .
D. 271,023 10/1983 Saidat .
D. 272,074 1/1984 Saidat .
D. 288,937 3/1987 Barrett .
D. 309,744 8/1990 Stumpf .
4,607,559 8/1986 Armin .
4,915,009 4/1990 Kunstadt .
4,919,033 4/1990 Markov et al. .

*Primary Examiner*—Stanley J. Witkowski
*Attorney, Agent, or Firm*—Woodard, Emhardt, Naughton, Moriarty & McNett

[57] ABSTRACT

An electric violin includes a body having a top, bottom and a ribcage situated between the top and bottom. A neck is attached to the body and includes an unfretted fingerboard. A bridge is attached to the body and strings extend from the distal end of the neck over the bridge and are attached to the body. The body includes a narrow portion adjacent the neck enabling easy access to the upper portion of the fingerboard. The fingerboard portion of the neck extends over the body a fixed distance. The underside of the neck includes a projection which defines a first registration point normally associated with the fourth finger position of a violin. The neck also includes a second projection located on the underside of the neck that defines a second registration point for a predetermined fingerboard position, preferably the eighth finger position corresponding to a one octave higher position on the strings. An optional third registration location is defined by a groove located on the underside of the fingerboard where the fingerboard extends over the body and is associated with a predetermined finger position near the extreme upper portion of the neck thereby enabling positive fingering of the strings to produce musical notes on the upper portion of the neck. The bridge includes piezoelectric transducers for detecting vibrations of the strings and producing corresponding electrical signals. The transducers are connected to amplifier electronics contained within the body of the violin. Electrical connectors mounted on the ribcage of the violin enable connection of the amplifiers within the body to external power amplifiers.

15 Claims, 5 Drawing Sheets

ELECTRIC VIOLIN WITH MULTIPLE REGISTRATION POINTS

FIELD OF THE INVENTION

This invention relates in general to stringed musical instruments and more specifically to violins, violas, cellos and bass instruments.

BACKGROUND OF THE INVENTION

Electric violins are used in all types of music. Prior development of electric violins has centered mostly on the method for producing an electronic signal from the vibrating strings. These methods are used to convert inexpensive factory instruments into electric acoustic violins. The latest designs include electronics and specially made bridges with multiple transducers that detect a signal from each string of the violin. The signals detected by the transducers are amplified within the instrument and the amplified signals are supplied to an external power amplifier with gain control. Further, sophisticated electronic signal interfacing techniques, such as MIDI (Musical Instrument Digital Interface) have prompted the use of electronic musical instruments.

Recently, some attention has been given to producing an instrument that offers increased accessibility to the upper playing positions. The upper playing positions are those located closest to the body of the violin. However, little attention has been given to classical design features of the violin. Some electric designs are merely a conventional violin neck with electronics attached.

Musicians develop tendonitis in the left hand, shoulders and back as a result of holding the instrument in playing position for an extended period of time and reaching around the body of the instrument in order to reach upper playing positions.

Since violins do not have frets like a guitar, the violinist uses certain physical features and dimensions of the violin design in order to facilitate proper location of the fingers on the strings. These dimensions are critical to the player when constructing a classical instrument.

In those designs for electric violins that incorporate a body little attention has been given to overall weight until recently. The electronic equipment inside the instrument weighs nearly half as much as a conventional violin. The angle of the strings as they pass over the bridge in many electronic designs has been modified so that the height deviation of the strings at the bridge is lessened, which is more like a guitar than a classical violin.

A violin design according to the present invention incorporates a standard angle at the bridge. This is important to the violinist. Standard violin strings are designed to operate at this angle. Also, when this angle is modified, it changes the feel of the string action when the violinist depresses the strings to the fingerboard. By maintaining this angle, the feel of a classical instrument has been preserved.

A violin which enables the violinist nearly unlimited access to the upper playing positions while retaining classical design features of violins is needed. Further, a violin that provides additional registration points to facilitate playing in the upper playing positions while paying strict attention to overall weight of the design is also needed.

SUMMARY OF THE INVENTION

An electric violin according to one aspect of the present invention comprises a body having a top, a bottom and a ribcage disposed between and attached to the top and the bottom near the periphery of the top and the bottom, the body having a narrow portion and a wide portion, a neck having a top side, a bottom side, a first end and a second end, the first end of the neck attached to the narrow portion of the body, the neck further including a first projection defining a first registration point, the neck also including a second projection defining a second registration point near the location where the neck is attached to the body, and the neck including a peg box situated at the second end of the neck and including a plurality of holes for receiving pegs, a bridge attached to the top of the body and including a plurality of transducers for detecting the vibrations of musical strings, a plurality of pegs inserted in the plurality of holes, a plurality of strings wrapped about corresponding ones of the plurality of pegs, the strings extending along the fingerboard over the bridge and attached to the body.

One object of the present invention is to provide an improved violin.

Another object of the present invention is to provide a violin that enables more convenient access to play notes on the upper portion of the neck.

Yet another object of the present invention is to provide an electric violin which includes certain traditional violin features to enable non-electric practice with the violin.

Still another object of the present invention is to provide a violin including additional registration points on the neck and fingerboard to assist the violinist in locating finger positions on the upper portion of the neck.

These and other objects of the present invention will become more apparent from the following description of the preferred embodiment.

DESCRIPTION OF THE PREFERRED EMBODIMENT

Figure 1:
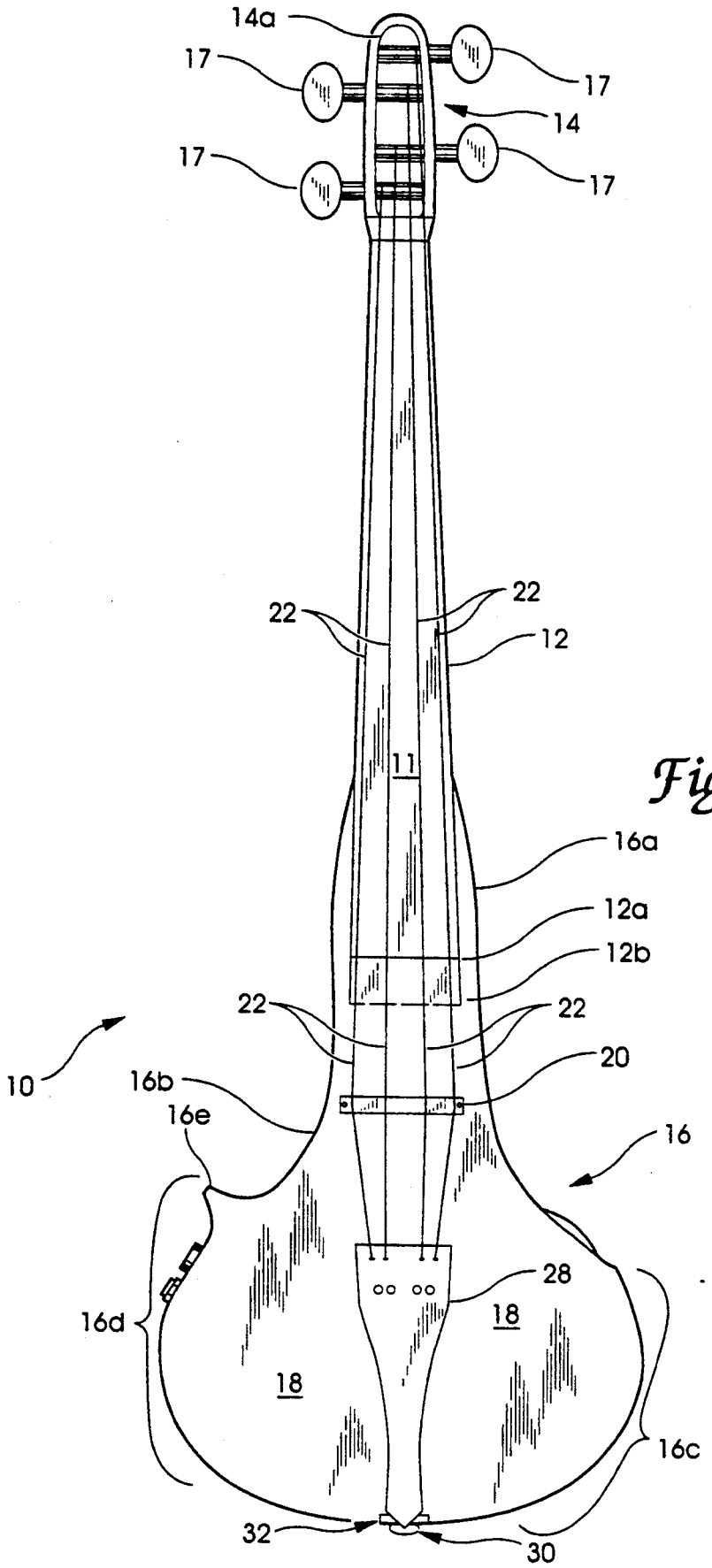
FIG. 1 is a plan view of an electric violin according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
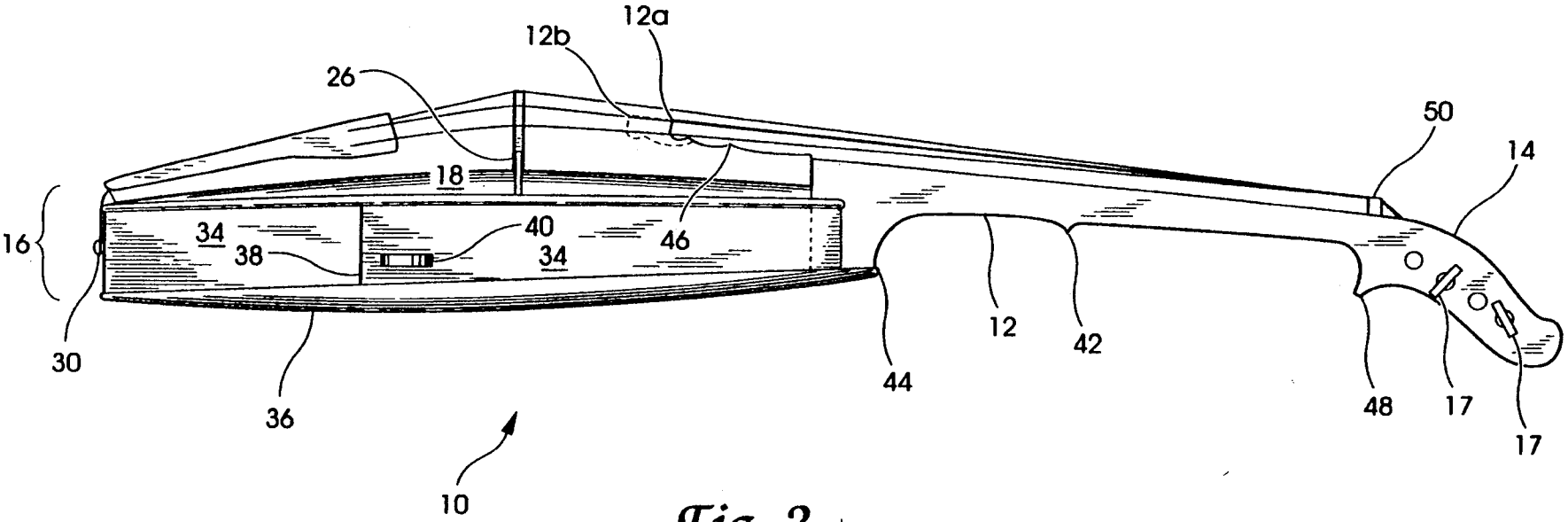
FIG. 2 is a side elevational view of the electric violin.
Figure 3:
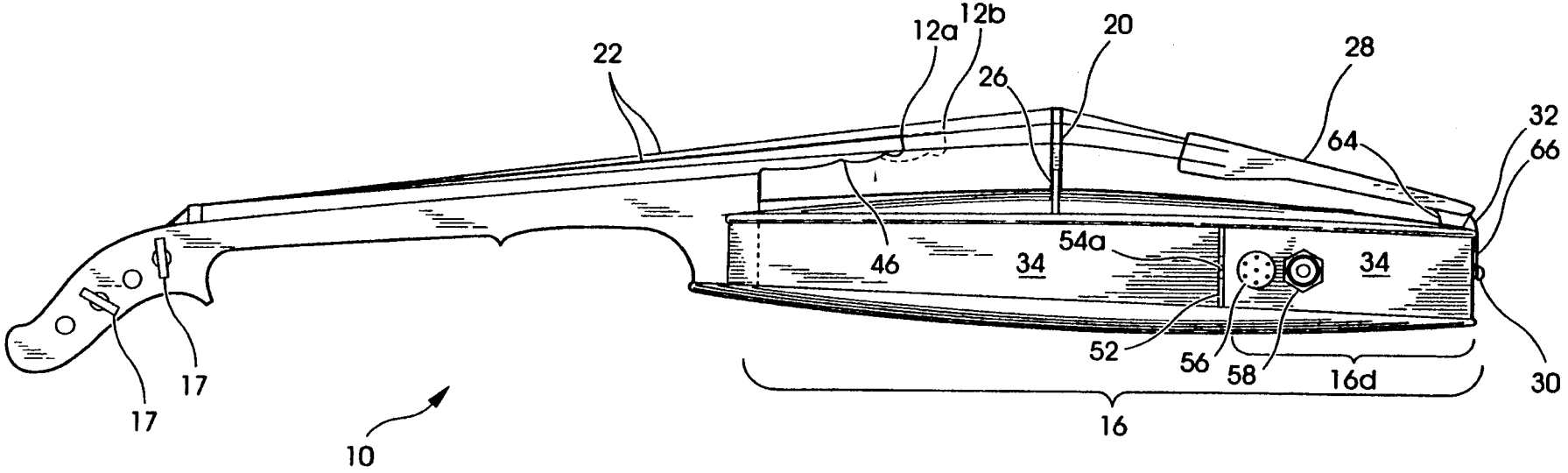
FIG. 3 is another side elevational view of the electric violin according to the present invention.

Referring now to FIGS. 1–3, an electric violin 10 according to the present invention is shown. The fingerboard 11 portion of the neck 12 is made of ebony, rosewood or other similar wood of standard classical width dimension. The standard length for a classical violin neck 12 extends to location 12*a*. The neck 12 may be lengthened (as indicated by the broken lines at 12*b*) to enable the violinist to play three full octaves on the fingerboard. The fingerboard 11 and neck 12 may be made wider to allow for optional five string configurations well known in the art. The five string option usually requires a slight lengthening of the peg box to accommodate an additional peg.

The body 16 of the instrument is of a double cutaway design flaring only slightly at the upper bout 16*a*. The center bout 16*b* is narrowed so that the violinist is allowed maximum access to all strings with the bow. The right hand lower bout 16*c* is constructed in a manner reminiscent of a 17th century viol. The left hand lower bout 16*d* and corner 16*e* are constructed in accordance with the classical lines of Andrea Amati's violins. The top or sound board 18 of the body 16 is constructed of quarter split straight grain spruce. The top 18 is carved at the edges in the traditional fashion (the edge profile is shown in detail in FIGS. 2 and 3). The top 18 is located onto the ribcage (shown in FIGS. 2 and 3) with wooden locator pins and attached using adhesives, also a traditional feature. The bridge 20 incorporates piezoelectric transducers located beneath the strings 22. The bridge 20 is manufactured by Zeta Manufacturing Company of 2230 Livingston St., Oakland, Calif. 94606 and is available as an OEM installation kit. The bridge includes an electrical cable that extends downward through the top 18 to connect the transducers of the bridge to the Zeta circuit board 24. The circuit board includes separate preamplifier circuits for each string and a summing amplifier back shown in FIG. 5. The bridge supports 26 (shown in FIGS. 2 and 3) are manufactured of wood and match the wood of fingerboard 12. The bridge supports or stand-offs 26 supplied with the Zeta kit are plastic and metal.

The tailpiece 28 is of wood and includes metal screw adjusters (not shown) well known in the art to facilitate fine tuning of the strings. The tailpiece 28 is modified in order to accommodate the requirement of the electronics so that the strings are electrically grounded. The end pin 30 is a standard violin after market accessory. Saddle 32 is made of the same hardwood as the fingerboard and attached to the corner edge of top 18 and situated directly over the pin 30.

The peg box 14 is constructed without traditional scroll engraving. The inside upper edge 14*a* is curved to match the outside of the peg box. The disclosed design uses half size standard after-market violin pegs 17 in order to make the peg box appear more streamlined.

The strings 22 are standard violin strings that are wrapped in metal and conduct electricity.

Referring now to FIG. 2, a side view of the right side of the instrument 10 is shown. A ribcage 34 is situated between the top 18 and the bottom 36 and is tapered from the end pin 30 towards the neck 12. The tapered ribcage 34 makes the third octave positions on the fingerboard 11 more accessible to the violinist. Near the viol shaped corner 38, the volume control thumbwheel 40 protrudes through an opening in the ribcage 34. The volume control 40 includes physical attributes the violinist can note or feel when the volume control is adjusted or set to a predetermined desired level. The volume control is located on the other side of the corner 38 (as opposed to other violins known in the art) in order to provide clearance from the standard shoulder rest most violinists use. Thus, the volume control 40 is more readily accessible by the violinist.

The neck 12 is extended toward the body of the instrument beyond the traditional (fourth position) registration point 42 which normally forms the heel of the neck in traditional violin designs. The neck 12 has a small protrusion 42 that corresponds with the position of a conventional violin neck heel or registration location. The heel of the neck 12 is located so that it defines a second reference location 44 or registration point thereby enabling the violinist to register from the point 44 and "finger" or locate those notes that are at or near one octave above the open strings.

The fingerboard 11 includes a groove or notch 46 located where the fingerboard 11 overhangs the body 16 of the instrument 10. The groove 46 is positioned such that it becomes a reference point for finding locations for the placement of the fingers on the strings to produce notes at or near two octaves above the open strings when playing in thumb position.

The peg box 14 includes a traditional thumbstop 48 at the string nut 50. The neck is made of quarter sawn maple with the grain oriented in the traditional fashion. The string nut 50 is made of the same wood as the fingerboard.

Referring now to FIG. 3, a side view of the left side of the violin 10 is shown. A traditional violin corner 52 is included in the design of body 16 and contouring of the ribcage 34. Mounted within the body 16 and protruding through a hole at 52 in the ribcage 34 is a power switch 54 (see FIG. 4) having a lever 54*a* positioned in such a manner that when the lever 54*a* is in the "off" position the lever protrudes into the C bout 16*d*. When turned "on", the lever 54*a* is wholly located in the corner 52 and out of the violinists way. Near corner 52 are two output jacks or connectors 56 and 58 necessitated by standard Zeta electronics. Connector 56 is an eight pin DIN connector attached internally to the ribcage 34. The connector 56 provides four connections for signals corresponding to each string, a connection for a "mixed" signal including all four string signals, a ground signal connection and a power signal connection. Connector 58 is a switched telephone jack and includes three connections. Two of the connector 58 connections are internal and connect a battery 60 (see FIG. 4) to the amplifier circuit board 24 (see FIG. 4) located within the body 16. A single "mixed" signal containing signals from each of the four strings is available at the connector 58 and is intended as an input signal for a power amplifier. A ground connection is established between the strings and the amplifier board 62 via a ground conductor 64. Ground conductor 64 is routed out from within body 16 through a hole located beneath the tail piece 28 and connected to each of the strings 22. The strings must be grounded to prevent electrical shock to the violinists fingers and to enable proper operation of the transducers in bridge 20.

FIG. 3 also illustrates the tail gut 66 attached to tail piece 28. The tail gut 66 is a loop of polymer line looped about end pin 30 before the strings 22 are wound taught about pegs 17. The tail gut (made of monofilament nylon) is also dressed over saddle 32 (a small wooden piece). When the strings 22 are attached to the tail piece 28 and subjected to tension via wrapping about pegs 17, the tail piece 28 is suspended in position between the bridge 20 and the saddle 32 in a conventional fashion well known to those skilled in the art.

Figure 4:
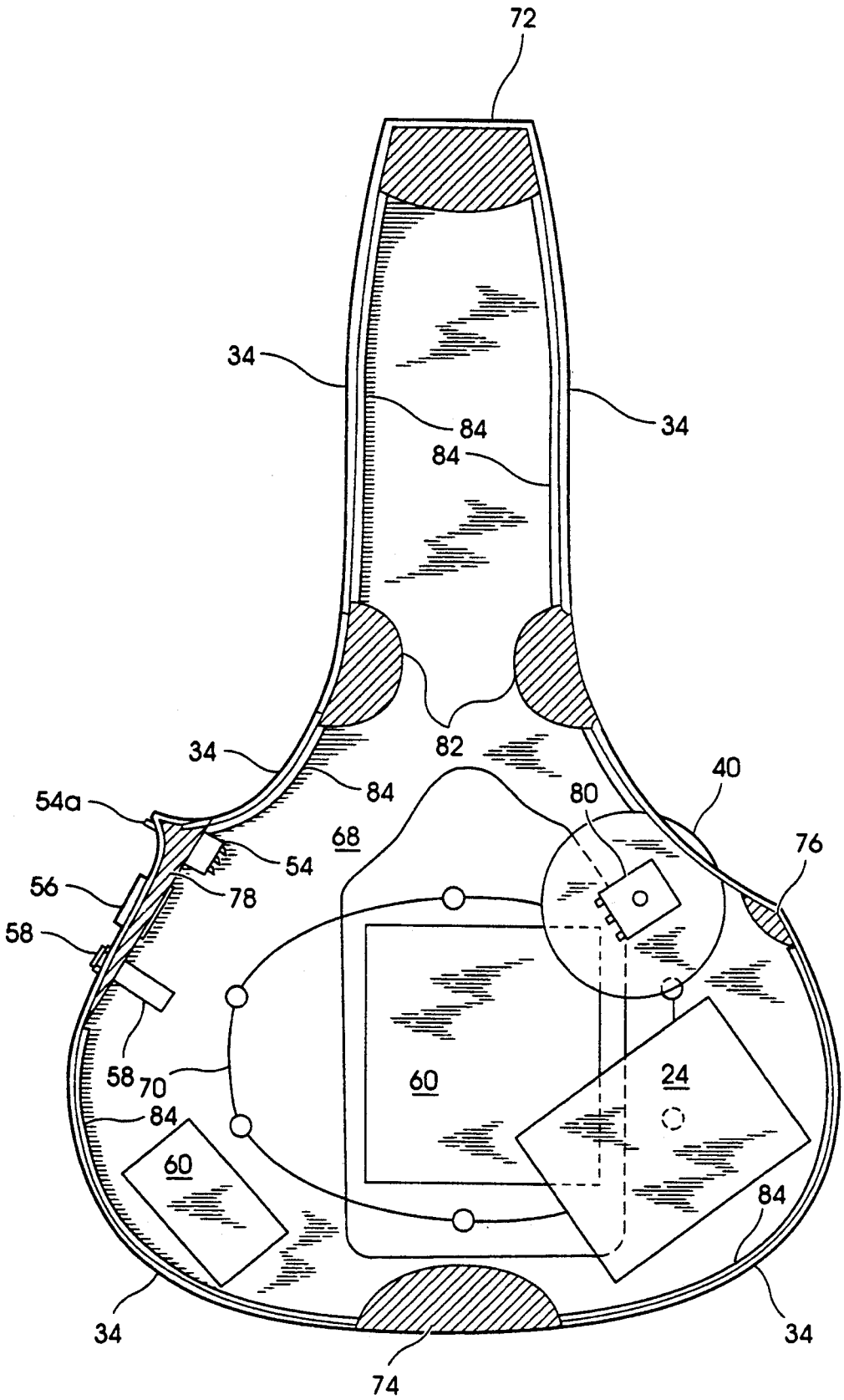
FIG. 4 is plan view of the violin body with the top cover removed to reveal the internal details of the body.

Referring now to FIG. 4., a plan view of the violin body 16 is shown with the top removed. Bottom 68 is made of carved maple in the traditional fashion. Bottom 68 is located onto the ribcage 34 with wooden locator pins (not shown) in the traditional manner. In the center of the lower bout is a door 70 sawn from the bottom. The door is temporarily glued in place while carving. It is secured with six countersunk screws (not shown).

The ribcage is constructed using bent maple in the traditional manner known to those skilled in the art. Blocks 72 and 74 are located in positions generally known to violin makers as requiring additional support. Block 76 provides added support in the lower corner. Block 78 inside the Amati style corner is extended toward the end button to strengthen the area where the connectors 56 and 58 are located. Battery 60, circuit board 24, switch 54 and potentiometer 80 are attached to the interior of the body and isolated from the body with sound absorbing material such as foam (not shown). Switch lever **54*a* is also shown. Volume control thumbwheel 40 is attached to potentiometer 80. A suggested material for thumbwheel 40** is clear acrylic.

The instrument 10 has no upper corners (in the upper bout) so the normal upper corner blocks are not required. Blocks 82 provide support to the underside of the top to counteract the string tension on the top of the body applied to the bridge. All blocks are made of spruce or willow wood.

Linings 84 are attached using adhesives to the ribcage 34 and the top or bottom cover in the traditional manner of violin construction. Linings are necessitated in view of the thin walls of the ribcage which may be less than two millimeters in thickness. The linings 84 have a triangular cross-section. The upper and lower edges of the ribs are lined in the traditional manner in order to give the instrument enough strength to support the tension of the strings. The body design provides room inside the box to accommodate future installations of electronic signal processing circuitry.

Figure 5:
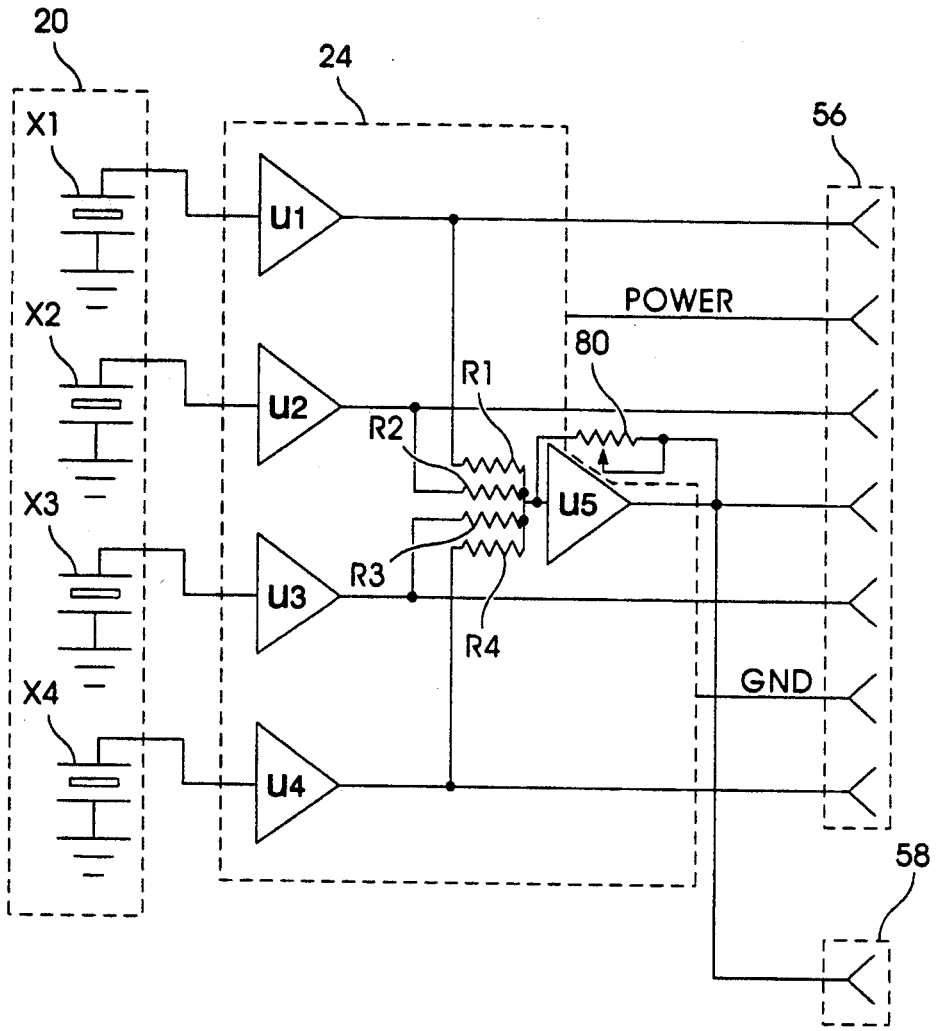
FIG. 5 is a schematic diagram of the electrical components contained within the electric violin of FIGS. 1–4.

FIG. 5 is a schematic diagram of the electrical components of the bridge 20 and the circuit board 24. The bridge includes (typically) four piezoelectric crystals or transducers X1–X4. A five crystal bridge is also contemplated for a five string instrument. Transducers X1–X4 are each in physical contact with one of the strings 22. Each transducer X1–X4 produces a signal corresponding to the vibration of a corresponding string. The circuit board 24 includes individual amplifiers U1–U4 (one each for each transducer X1–X4) that amplify the signals from the transducers X1–X4 and a summing amplifier U5. Amplifier U5 produces an output signal that is a sum of the output signals from the amplifiers U1–U4. Potentiometer 80 controls the gain of amplifier U5. Resistors R1–R4 provide isolation between the outputs of amplifiers U1–U4 and additionally determine the gain of amplifier U5 in conjunction with the resistance of potentiometer 80. The output of amplifier U5 is supplied to connectors 56 and 58. The output signals from amplifiers U1–U4 are supplied to connector 56. Battery 60 (not shown in FIG. 5) supplies power to the amplifiers U1–U5 in the manner known to those skilled in the art. Additionally, a switch that is integral with connector 58 (activated when a mating plug is inserted into connector socket 58, the switch supplying battery power to circuit board 24 from the battery) is not shown. External power and ground (GND) connections are also shown.

The hollow body construction of the violin 10 offers a pleasing acoustical muted sound. The violinist will appreciate muted acoustical response when using the violin to practice without amplification. By removing the door 70 on the back of the instrument, the acoustical volume is increased if desired.

The neck and fingerboard design are contemplated as being incorporated into an electric-acoustic or an acoustic instrument in conjunction with body modifications to accommodate the same.

The physical dimensions of the instrument 10 lends itself to the possibility of constructing it from an injection moldable material.

A molded acoustic violin is known. The entire body and neck of the instrument are finished with lacquer or other well known wood finishing techniques. This approach departs from traditional finishing techniques in order to make the neck more durable and resistant to stresses. Optionally, the body may be finished in the traditional fashion with varnish and a bare wood feeling finish on the neck.

It is also contemplated that the signals available at the connectors may be supplied to a modulator/radio transmitter device contained within the body of the violin. The addition of a radio transmitter enables a cordless signal connection to external electrical devices for processing and amplification of the signals detected by the transducers.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. An electric violin comprising:

a body having a top, a bottom and a ribcage disposed between and attached to said top and said bottom near the periphery of said top and said bottom, said body having a narrow portion and a wide portion;

a neck having a top side, a bottom side, a first end and a second end, said first end of said neck attached to said narrow portion of said body, said neck further including a first projection defining a first registration point at a fourth position of the neck, said neck also including a second projection defining a second registration point substantially corresponding with an octave position near the location where said neck is attached to said body, and said neck including a peg box situated at said second end of said neck and including a plurality of holes for receiving pegs;

a bridge attached to the top of said body and including a plurality of transducers for detecting the vibrations of musical strings;

a plurality of pegs inserted in said plurality of holes;

a plurality of strings wrapped about corresponding ones of said plurality of pegs, said strings extending along said fingerboard over said bridge and attached to said body.

2. The violin of claim 1 wherein said first and said second registration points are located on the bottom side of said neck.

3. The violin of claim 2 wherein said neck includes an unfretted fingerboard on the top side of said neck.

4. The violin of claim 3 wherein said fingerboard extends over said body and wherein said fingerboard includes a groove defining a third registration point located over said body.

5. The violin of claim 4 including a multi-channel amplifier disposed within said body and having a plurality of inputs and an output, and wherein said bridge includes a plurality of transducers, one for each of said plurality of strings, and wherein each of said transducers produces a string signal, said string signals being supplied to the inputs of said multi-channel amplifier, and wherein said amplifier sums and amplifies said string signals to produce a summed amplified signal at said output.

6. The violin of claim 3 wherein said body includes a removable door enabling access to the interior of said body and when removed increases the acoustical response of said violin.

7. The violin of claim 1 wherein said fingerboard extends over said body and wherein said fingerboard includes a groove defining a third registration point located over said body.

8. The violin of claim 7 wherein said first and said second registration points are located on the bottom side of said neck and wherein said neck includes an unfretted fingerboard.

9. A stringed instrument comprising:

a body having a top, a bottom and a ribcage disposed between and attached to said top and said bottom near the periphery of said top and said bottom, said body having a narrow portion and a wide portion;

a neck having a top side, a bottom side, a first end and a second end, said first end of said neck attached to said narrow portion of said body, said neck including an unfretted fingerboard on said top side and a first registration point located at a fourth position of the neck and defined by a first projection, said neck also including a second registration point defined by a second projection on said neck near the location where said neck is attached to said body, said second projection substantially corresponding in position with an octave finger position, and said neck including a peg box situated at said second end of said neck and including a plurality of holes for receiving pegs;

a bridge attached to the top of said body;

a plurality of pegs inserted in said plurality of holes;

a plurality of strings wrapped about corresponding ones of said plurality of pegs, said strings extending along said fingerboard over said bridge and attached to said body.

10. The instrument of claim 9 wherein said first and said second registration points are located on the bottom side of said neck.

11. The instrument of claim 10 wherein said fingerboard extends over said body and wherein said fingerboard includes a groove defining a third registration point located over said body.

12. The instrument of claim 11 including a multi-channel amplifier disposed within said body and having a plurality of inputs and an output, and wherein said bridge includes a plurality of transducers, one for each of said plurality of strings, and wherein each of said transducers produces a string signal, said string signals being supplied to the inputs of said multi-channel amplifier, and wherein said amplifier sums and amplifies said string signals to produce a summed amplified signal at said output.

13. The instrument of claim 12 wherein said body includes a removable door enabling access to the interior of said body and when removed increases the acoustical response of the instrument.

14. The instrument of claim 13 including a connector means mounted on said ribcage for enabling the delivery of said summed amplified signal and said string signals to an external electronic device.

15. The instrument of claim 9 wherein said instrument is a violin or a viola.

* * * * *